US009552798B2

(12) United States Patent
Schimmel-Vogel

(10) Patent No.: US 9,552,798 B2
(45) Date of Patent: Jan. 24, 2017

(54) PIANOFORTE INSTRUMENT, IN PARTICULAR A PIANO, WITH A HOUSING ON BEARING POINTS

(75) Inventor: Hannes Schimmel-Vogel, Braunschweig (DE)

(73) Assignee: SCHIMMEL-VERWALTUNGSGESELLSCHAFT MIT BESCHRANKTER HAFTUNG, Braunschweig (DE)

( * ) Notice: Subject to any disclaimer, the term of this patent is extended or adjusted under 35 U.S.C. 154(b) by 0 days.

(21) Appl. No.: 14/112,986

(22) PCT Filed: May 14, 2012

(86) PCT No.: PCT/EP2012/058897
§ 371 (c)(1),
(2), (4) Date: Jan. 2, 2014

(87) PCT Pub. No.: WO2012/152946
PCT Pub. Date: Nov. 15, 2012

(65) Prior Publication Data

US 2014/0165815 A1 Jun. 19, 2014

(30) Foreign Application Priority Data

May 12, 2011 (DE) ..... 10 2011 101 753

(51) Int. Cl.
*G10C 3/02* (2006.01)
*G10C 1/02* (2006.01)
*G10F 1/02* (2006.01)

(52) U.S. Cl.
CPC . *G10C 3/02* (2013.01); *G10C 1/02* (2013.01); *G10F 1/02* (2013.01)

(58) Field of Classification Search
USPC ..... 84/177
See application file for complete search history.

(56) References Cited

U.S. PATENT DOCUMENTS

| | | | | |
|---|---|---|---|---|
| 106,317 A | | 8/1870 | Bull | |
| 2,272,848 A | * | 2/1942 | Miller | A47B 91/024 16/19 |
| 2,431,350 A | * | 11/1947 | Stein | G10C 1/02 84/176 |
| 2,486,354 A | | 10/1949 | Zaiser | |
| 2,998,741 A | * | 9/1961 | Thurston et al. | 84/733 |
| 3,038,194 A | * | 6/1962 | Arenson | A47B 91/06 16/43 |
| 3,191,212 A | | 6/1965 | Reiss, Sr. et al. | |
| 3,363,499 A | | 1/1968 | Matsumoto | |

(Continued)

FOREIGN PATENT DOCUMENTS

| | | |
|---|---|---|
| CN | 201703193 U | 1/2011 |
| EP | 2165625 A1 | 3/2010 |

*Primary Examiner* — Christopher Uhlir
(74) *Attorney, Agent, or Firm* — Barlow, Josephs & Holmes, Ltd.

(57) ABSTRACT

A pianoforte instrument, in particular a piano, has a base. Several bearings serve to support the pianoforte instrument on a floor. A height adjuster is also provided, which permits a height adjustment of the slide element relative to the base and/or a console. A device that facilitates transport is preferably provided on each of the bearings. The device that facilitates transport has a slide element, which permits sliding on the floor.

9 Claims, 3 Drawing Sheets

(56) References Cited

U.S. PATENT DOCUMENTS

| | | | | |
|---|---|---|---|---|
| 4,277,923 | A * | 7/1981 | Rebentisch | E04F 15/02458 52/126.6 |
| 6,055,704 | A * | 5/2000 | Leibman | 16/35 R |
| 2009/0025184 | A1* | 1/2009 | Clarke | A47B 91/066 16/42 T |
| 2009/0120264 | A1* | 5/2009 | Wheeler et al. | 84/174 |

* cited by examiner

PIANOFORTE INSTRUMENT, IN PARTICULAR A PIANO, WITH A HOUSING ON BEARING POINTS

BACKGROUND OF THE INVENTION

The invention relates to a pianoforte instrument, in particular a piano, with a base and with several bearings for support on a floor.

Pianoforte instruments, in particular pianos, in addition to the primary elements for producing sound, such as, for instance, the keyboard, the strings, and the soundboard, also have a housing with bottom frame and top frame, in which these elements are arranged or to which they are attached.

Particularly for pianos, such a housing with bottom frame and top frame, in which the soundboard and the strings are arranged, rests on a base with a baseboard. Placed on the top frame is the keyboard with a keybed, a lock rail, and a fallboard. The user must be able to operate the keyboard. It therefore projects forward from the body or the bottom frame. In front of the bottom frame below the keyboard is a free space, in which the knees and lower legs of the pianist are situated when the piano is played, while the hands of the pianist move on and over the keys of the keyboard also when the piano is played.

The keyboard is additionally supported on either side of the pianist. Provided for this purpose are consoles, each of which is supported on a foot. The feet are joined to the baseboard.

An aspect of pianoforte instruments that has received too little attention lies in the problem posed by an uneven underlying surface. In the case of grand pianos, this aspect is addressed in that grand pianos stand on three bearings, thereby permitting a three-point bearing, which is stable even for uneven floors.

A similar solution is proposed, for instance, in US 2009/0120264 A1, which describes a pianolike electronic musical instrument, in which, quite intentionally, besides two front bearing legs, a third rearward bearing leg, turned away from the player, is provided so as, in turn, to create a stable three-point bearing.

However, similar concepts are also known already from older publications, such as U.S. Pat. No. 2,486,354, where, in order to provide a solution for stability and for compensation for uneven floors, the entire piano is constructed on a platelike base, which, in turn, rests once again with three bearings on the floor.

For pianos and comparable pianoforte instruments, which predominantly rest with four bearing points on the floor, generally in practice makeshift washers are placed underneath one of the bearings so as to prevent by eye at least a tilting of the piano.

This problem is all the more aggravating when the piano is to be placed at changing locations or even when only a change in position within a room or a hall is to be undertaken, in which case, owing to the inevitably existing slight differences in floor unevenness, a potential compensation found in one case is certainly inappropriate and has to be reselected and readjusted.

This is further complicated by the fact that, when the problem posed is subject to closer expert examination, preventing a tilting of the piano is not the concern or not the sole concern. It should be considered that quite substantial forces act in a piano, these forces arising not only due to the weight of the components, but also due to the fact that, owing to their tension, tensioned strings exert substantial forces on their fixing points and the soundboard. The tensile forces that can act in the instrument owing to the set of strings can amount to around 20 tons.

A nonuniform load on the different bearing points is accordingly transmitted to the strings, leading to a change in sound therein. This is an effect that is undesirable, especially for a pianoforte instrument. This effect also arises when the piano rests in place even without so-called tilting, but the bearings are subject to quite differing loads.

SUMMARY OF THE INVENTION

The problem of the invention, by contrast, is to propose a generic kind of pianoforte instrument, which creates a possibility of achieving an improved tuning stability in spite of floor unevenness, without having to resort to complex and complicated designs, such as ones with complete floor plates and an artificial three-point bearing, such as in U.S. Pat. No. 2,486,354.

This problem is solved by means of the invention for a generic kind of pianoforte instrument in that two of the bearings are each equipped with a height adjuster and in that the height adjuster enables a height adjustment of the bearing relative to the base and/or to a console.

This possibility permits a substantial improvement to be achieved in the tuning stability of a pianoforte instrument.

What is involved here is a four-point bearing, in which two of four bearing points are designed to be adjustable in height. As a result, there exists here, too, the possibility of compensating for unevenness in the underlying surface, namely by actively shifting and/or adjusting the bearing points.

However, the invention goes clearly beyond the simple compensation for unevenness and hence the avoidance of a tilted instrument.

Namely, it becomes possible to achieve a sturdy bearing on all four bearings for the tuning stability of the pianoforte instrument and thus to take into account flaws in the high intrinsic weight of a piano and the extreme tensile forces that act in the instrument owing to the set of strings. If, namely, one of the four bearing points should have no load, the sound box would deform to a certain extent, even without the instrument starting to tilt. On account of this mentioned deformation, the geometries in the instrument and hence also the tensile forces in the set of strings would shift. Furthermore, in the case of the resonating strings of a pianoforte instrument, the acting tensile force is proportional to the pitch and, consequently, an unintentional change in these tensile forces also results in an unintentional change in pitch.

However, the height adjustment of just two bearings, which is made possible according to the invention, permits the adjustment of a uniform load on all four bearings. The adjustability of just two bearings independently of each other also permits manual adjustment to be performed without great exertion. The user can feel very clearly whether the bearing that is just then being adjusted by him or her has no load or has a load or whether it possibly has no contact whatsoever with the floor, which would automatically result in tilting.

It is of particular advantage when the two front bearings facing a keyboard are each equipped with a height adjuster.

Preferably, this adjustability is provided on one or both bearing points that constitute the front points with respect to the player. This has the advantage that the readjustment can also occur in a place where the player has access, this being of importance in particular when, in view of a lecture, he or she just wishes to move the piano to another point in a room and is then naturally interested in being able himself or herself to directly compensate for a floor position that may have changed after this moving.

It is further particularly preferred when a device that facilitates transport is provided on each of the bearings and when each device that facilitates transport has a slide element, which permits sliding on the floor.

On occasion, namely, it is also necessary to move, to transport, or to shift pianos. Feet make this quite difficult, because such rigid, tightly screwed-on feet made of wood or plastic hardly slide or do not slide at all on the floor and may also leave behind very ugly and undesired scratches.

Especially the great weight of pianos makes transport difficult. Nonetheless, it must be possible to move a piano within a dwelling or within an event hall. An optimal point of placement must be found and a dwelling is also occasionally redecorated so that, in some circumstances, the piano has to be placed at the other end of the living room.

Therefore, one caster is often attached beneath the base to each of the feet joined to it, hence a total of four casters. These casters serve to enable the piano to be moved and transported. Much effort has already been invested in these casters in order to design them to be as smooth-running as possible. Brass casters are generally provided for this purpose in conventional practice. The piano rests on a total of four bearing points and such a brass caster is conventionally provided at each of these bearing points.

It is disadvantageous in this case, among other things, that the pianos are transported on these brass casters only relatively seldom, which tends to make these brass casters run sluggishly. The high bearing weight per unit area also leads repeatedly to the occurrence of scratches and damage when pianos are actually to be moved on these casters, for instance over a parquet floor.

Brass casters at the bearing points of a piano are also not unanimously popular in visual terms.

In this preferred embodiment of the invention, it is consequently achieved that a pianoforte instrument is not only more stable in tuning compared to conventional pianoforte instruments, but also is equipped with a better possibility for occasional transport within living spaces or event locations.

The brass casters hitherto exclusively utilized in the prior art are completely dispensed with in this preferred embodiment. This is highly unusual for the skilled practitioner, since casters and wheels are regarded by the person skilled in the art, on the basis of his or her experience, as the means of choice to move around relatively heavy objects. Dispensing with this proven and popular means seems anachronistic. This is all the more true since the skilled practitioner knows that, without casters, conventionally used feet made of wood or plastic are a fortiori unsuitable for moving or transporting a piano. If one attempted to allow a piano to "slide" on such a foot, damage to the flooring would be highly likely.

It should be noted, however, that, when casters are used, the area through which the entire weight of the piano is carried onto the flooring corresponds ultimately only and exclusively to four relatively narrow and short linear stretches, namely the bearing lines of the four brass rollers or brass casters on the floor at the four bearing points. Hence, when conventional dimensions are used, what is involved are four short stretches, each at most two centimeters in length, with the bearing area already being formed through impression of these brass casters onto the underlying floor surface and being only a few millimeters wide.

These areas do not change in that the brass casters roll over the floor and the forces are thereby constantly introduced into the floor over other portions of the outer area of each of the brass casters.

The area available in this embodiment is clearly greater. The area of four elements is likewise constantly available, namely four slide elements, one on each of the bearings. The base plate also has roughly the same length dimension, albeit a markedly broader width of 1 or 2 cm in each case, for example, which far exceeds the bearing area of a brass caster.

As a result, the pressure on the underlying surface, for example on a parquet floor, is markedly reduced at each individual bearing point and thus it is possible to avoid damage.

A whole series of advantages are directly achieved in this embodiment. By completely dispensing with the casters and replacing them with slide elements, it is possible to prevent the scratches in parquet floors or other floors that occur conventionally during each transport of a piano.

Furthermore, when the fourth caster is suspended a small distance above the floor, the danger conventionally arises that the vibrations of the strings and the soundboard are transmitted to this caster such that slightly jingling vibrations of the caster against the floor can result. These disturbing noises can hardly be localized by an inexperienced and un-informed private user, but they can lead to an impairment of the sound, especially when a private user who is already a sophisticated player is involved.

These problems are also avoided in accordance with the invention. The provision of two of the four bearing points with a height adjuster enables overall compensation for any floor unevenness. In this way, it can be ensured that the weight of the pianoforte instrument is carried via all four bearing points uniformly onto the underlying surface, that is, onto the floor or other contact area.

This can preferably be accomplished in that the piano is equipped with two identically designed slide elements, which particularly may be composed of a base plate and a threaded bolt. In trials, an M 12 bolt has proven effective as the threaded bolt.

The two rear bearing points with respect to the player are likewise equipped with slide elements, although they are not necessarily equipped so as to be adjustable. Basically one appropriately equipped bearing point would suffice for adjustability; however, the use of especially identically designed adjustable slide elements has, besides the advantages already discussed above, the advantage of enabling the player to access directly the side judged by him or her to be uneven, without the player having to resort to tedious trial and error. Moreover, this affords a visual balance between left and right.

The slide elements are preferably provided with an engagement possibility for an Allen wrench. This is also readily comprehensible for non-technicians and nonetheless also suitable for providing, due to extension and retraction, a perfect adjustment possibility in spite of the relatively high weight loads of a piano.

This adjustment possibility ensures that the weight can be distributed uniformly over all four bearing points and the sound unit of the piano remains dimensionally stable.

The contact area is covered especially preferably with a plastic that can slide and is abrasion-resistant. The material has proven particularly effective in tests. It is offered commercially, among other names, under the trade name "Delrin." On the one hand, the ability of the piano to slide and move is quite well supported in this way, without scratches resulting in the floor, for instance in a parquet floor. On the other hand, the forces that are required for moving the piano are reduced in this way and, finally, it is avoided that traces of abrasion are left on the floor or the slide elements are worn down too quickly.

The enlarged support area due to the slide elements has the effect, as mentioned, that markedly less spot pressure is exerted on the floor than is the case conventionally when casters are used. Owing to the utilization of the slide elements according to the invention, the steady static pressure load of a piano on the floor causes markedly less damage due, for instance, to impression on the uppermost portions of the floor.

It is also not insignificant that a slider or a slide element, as the bottom end of an elegant console, visually constitutes a much more harmonic connection than can be the case due to a conventional brass caster. Brass casters always constantly show the viewer very clearly what their technical purpose is and they thus interfere with the clear overall esthetic appearance.

Moreover, the height adjustability of the bearing points, which is extremely appropriate for the tuning stability of pianoforte instruments, is also designed to be clearly more user-friendly owing to the use of slide elements in place of conventionally used casters. This is supported by the geometry of the slide elements. A slide element can be adjusted in height by turning by hand as long as it is free of pressure.

In a situation involving movement, the slide element need not be able to move, but rather remains at its height and thus slides as a solid body over the underlying surface or the area lying under it. By contrast, a caster conventionally provided at this point has two free axes of rotation, namely an axis of rotation that is concentric to the running area of the caster and another axis of rotation that is orthogonal to the former. A caster with a threaded shaft that is analogous to that of a slide element, for instance, cannot be adjusted in height by turning it by hand. Such a caster free of pressure would simply rotate around its free axis in a trial, without any change in height relative to the base or to the body of the piano. In order to be able to effect nonetheless a height adjustment, a tool would always be required in this case.

In this respect, too, there thus ensues an advantage for a combination of a slide element with a height adjuster.

BRIEF DESCRIPTION OF THE DRAWINGS

The invention will be described in detail below on the basis of a sketch. Shown are.

DETAILED DESCRIPTION OF THE INVENTION

Figure 1:
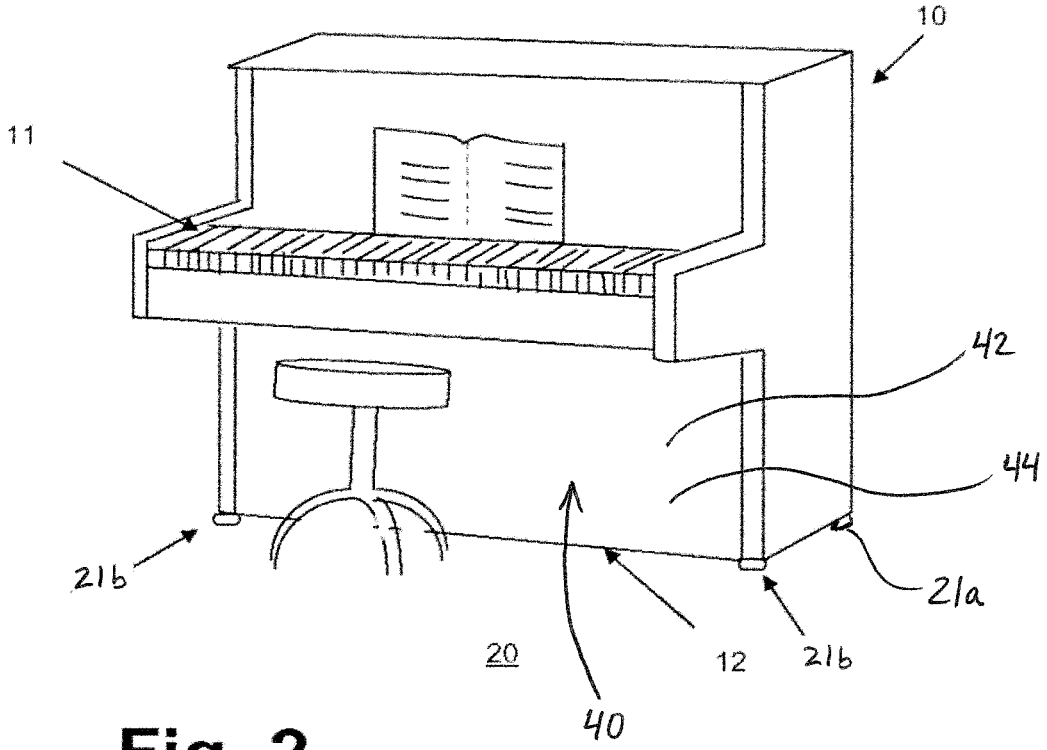
FIG. 1 is a schematic overall view of n embodiment of a piano according to the invention.

Shown in FIG. 1 is a piano 10 with a keyboard 11 and a body with top frame, bottom frame, and base 12, in which, among other things, the soundboard 42 and the strings 44 are located, which cannot be seen as such in the illustration.

The piano 10 rests on an uneven floor 20 and is supported on it by four feet or bearings 21. As may be imagined, only three of the feet carry the entire weight of the piano 10 onto the floor 20, whereas the fourth foot 21 or the fourth bearing is ultimately suspended free of pressure just above the floor 20.

On account of the substantial weight of the piano 10, this leads to the piano 10 being somewhat distorted, in contrast to FIG. 1, which is detrimental to the sound.

This problem is aggravated when the piano 10 is to be transported and hence the feet or bearings 21 are to be pulled over the floor 20. If the feet 21 in this case are equipped conventionally with brass casters, the latter scrape over the floor and have problems in carrying the weight onto the floor 20.

Figure 4:
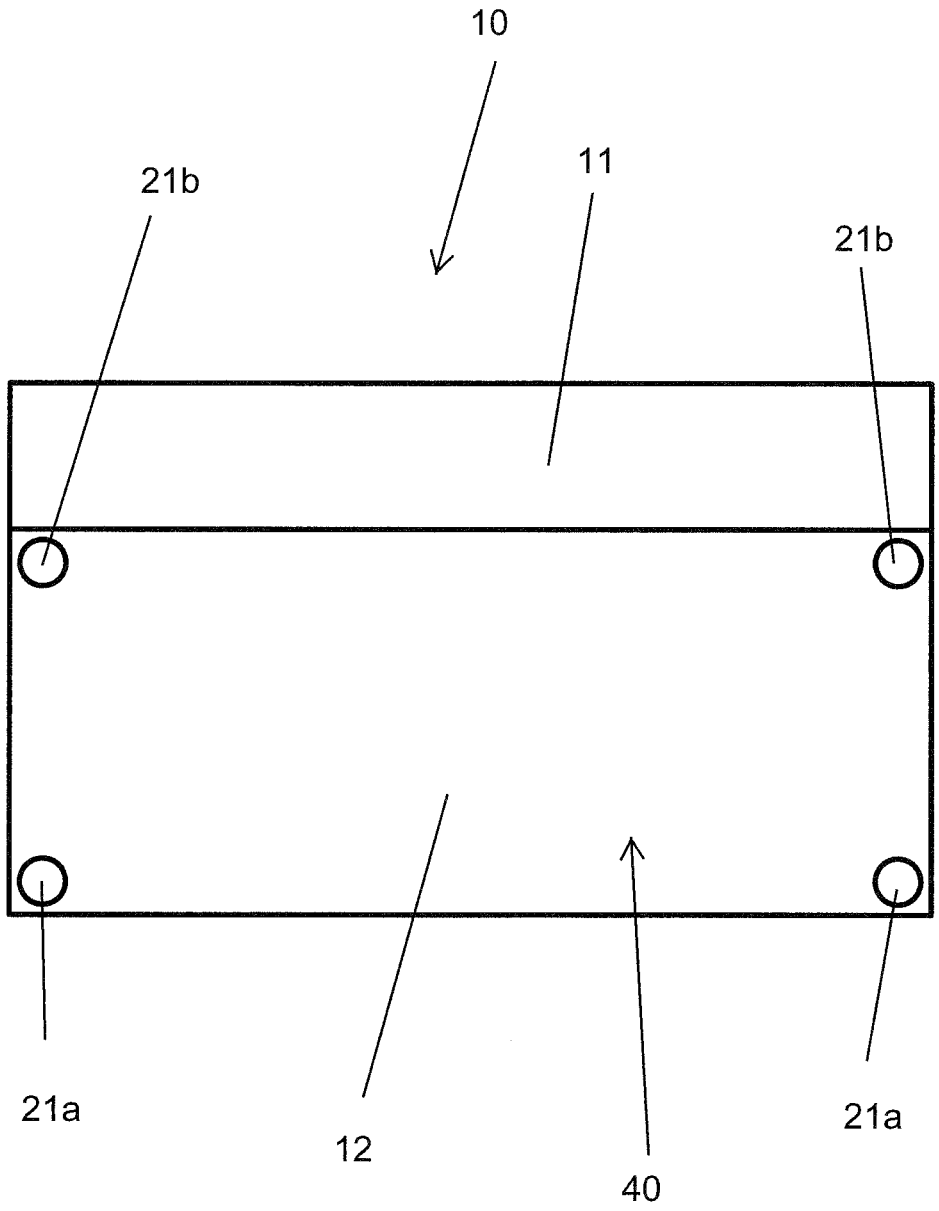
FIG. 4 is a bottom view of an embodiment of a piano according to the invention such as the one shown in FIG. 1.

According to the invention, therefore, the feet or bearings 21 are instead equipped with other forms of bearing elements 30. Each of these bearing elements 30 is equipped with a slide element 31. Two of these bearing elements 30 are additionally equipped with a height adjuster 32. FIG. 4 shows a bottom view of an embodiment of a piano according to the present invention such as the one shown in FIG. 1. The soundbox 40 contains the soundboard 42 and the strings 44. The piano has a keyboard 11 extending from its front side. The piano is supported by four feet or bearings 21. These four bearings 21 include two fixed height bearings 21*a* and two adjustable height bearings 21*b*. The two fixed height bearings 21*a* are located toward the rear side, and the two adjustable height bearings 21*b* are located toward the front side. The provision of two of the four bearing points with a height adjuster enables overall compensation for any floor unevenness. In this way, it can be ensured that the weight of the pianoforte instrument 10 is carried via all four bearing points (including the two fixed height bearings 21*a* and the two adjustable height bearings 21*b*) uniformly onto the underlying surface, that is, onto the floor 20 or other contact area. This uniform loading prevents the sound box 40 from deforming to an extent that the tensile forces in the set of strings would shift.

Figure 2:
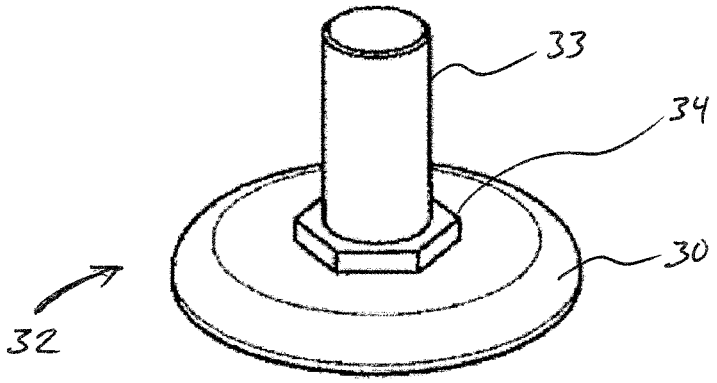
FIG. 2 is a perspective view of a detail from FIG. 1.

A corresponding cutout can be seen in FIG. 2, in which the region of a foot 21 with a bearing element 30 can be seen enlarged. It can be seen that the bearing element 30 has a slide element 31 and, in addition, a height adjuster 32, by means of which the slide element 31 can be moved upward and downward.

Moreover, the slide element 31 is covered with a layer that is particularly low-friction and abrasion-resistant. In this case, polyoxymethylene is preferred as the material.

The height adjuster 32 has a threaded bolt 33, which can be used for height adjustment of the bearing element 30 relative to the base 12 by means of an adjusting nut 34.

Figure 3:
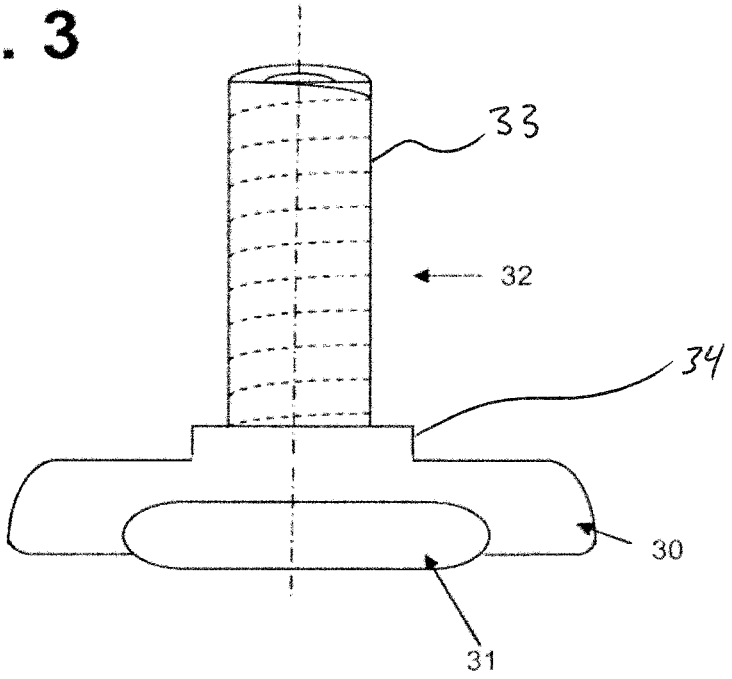
FIG. 3 is a schematic section through the detail of FIG. 2.

Shown in FIG. 3 is the bearing element 30 with the slide element 31 and the height adjuster 32 in sectional view.

It is not illustrated in the figure that the keyboard 11 is additionally supported via consoles (not illustrated). The consoles extend to the left and right of the user from the keyboard downward to the floor. These consoles can also be provided on their bottom end with bearings, with the feet 21 drawn in FIG. 1 then being replaced by these bearings 21 beneath the consoles. The consoles can be joined to the base 12 by a toe rail or a foot.

The invention claimed is:

1. A pianoforte instrument with a base (12) forming a soundbox and including a soundboard and strings within the base, a keyboard arranged at a front of the base and the base having four bearings (21) for support on a floor (20), hereby characterized in that two of the bearings (21*a*) are fixed height bearings, the fixed height bearings (21*a*) being located at a rear of the base, in that two of the bearings (21*b*) are adjustable height bearings each equipped with a height adjuster (32), the adjustable height bearings (21*b*) being located at the front of the base facing the keyboard, and in that each height adjuster (32) enables a height adjustment of the respective bearing (21) relative to the base (12) and/or to a console;

further characterized in that a device (30) that facilitates transport is provided on each of the bearings (21); and in that the device (30) that facilitates transport has a slide element (31) in each case, which permits sliding on the floor (20);

wherein the two adjustable height bearings (21*b*) cooperate with the fixed height bearings to permit adjustment of a uniform load onto all four bearings (21), to prevent deformities of the sound box, and to improve tuning stability in spite of floor unevenness; further characterized in that the device (30) includes a recess containing a majority of a main block of the slide element (31); wherein the slide element (31) has a substantially uniform geometry, lacking projections therefrom.

2. The pianoforte instrument according to claim 1, further characterized in that each slide element (31) is provided with a layer of polyoxymethylene.

3. The pianoforte instrument according to claim 1, further characterized in that each height adjuster (32) has a threaded bolt (33) and an adjusting nut (34), wherein rotation of the adjusting nut (34) effects height adjustment of the respective bearing (21) relative to the base (12) and/or to a console.

4. The pianoforte instrument according to claim 2, further characterized in that each height adjuster (32) has a threaded bolt (33) and an adjusting nut (34).

5. A pianoforte instrument comprising:

a base forming a soundbox 40 and including a soundboard 42 and strings 44 within the base;

a keyboard 11 arranged at a front of the base 12; and four weight bearing assemblies supporting said base on a floor, wherein two of said weight bearing assemblies are fixed height weight bearing assemblies located at a rear of the base, and wherein two of said weight bearing assemblies are adjustable height weight bearings assemblies each equipped with a height adjuster, the adjustable height weight bearing assemblies being located at the front of the base facing the keyboard, each height adjuster enabling a height adjustment of the respective adjustable height weight bearing assembly relative to the base, each of said weight bearing assemblies including a bearing element that facilitates transport, and a slide element received on the bottom side of said bearing element which permits sliding on the floor;

wherein said two adjustable height weight bearing assemblies cooperate with said two fixed height weight bearing assemblies to permit adjustment of a uniform load onto all four bearings, to prevent deformities of the sounds box and to improve tuning stability in spite of floor unevenness; wherein each beating element includes a recess containing a majority of a main block of the slide element; wherein each slide element has a substantially uniform geometry, lacking projections therefrom.

6. The pianoforte instrument according to claim 5, wherein each slide element is provided with a layer of polyoxymethylene on an outer surface of said respective slide element.

7. The pianoforte instrument according to claim 5, wherein each height adjuster has a threaded bolt extending from the respective bearing element, and each height adjuster has an adjusting nut, wherein rotation of the adjusting nut (34) effects height adjustment of the respective bearing (21) relative to the base (12) and/or to a console.

8. The pianoforte instrument according to claim 6, wherein each height adjuster has a threaded bolt extending from the respective bearing element, and each height adjuster has an adjusting nut.

9. A pianoforte instrument comprising:

a base forming a sound box 40 and including a soundboard 42 and strings 44 within the base;

a keyboard arranged at a front of the base; and four weight bearing assemblies supporting said base on a floor, wherein two of said weight bearing assemblies are fixed height weight bearing assemblies located at a rear of the base, and wherein two of said weight bearing assemblies are adjustable height weight bearing assemblies each equipped with a height adjuster, the adjustable height weight bearing assemblies being located at the front of the base facing the keyboard, each height adjuster enabling a height adjustment of the respective adjustable height weight bearing assembly relative to the base, each of said weight bearing assemblies including a bearing element that facilitates transport, and a slide element received on the bottom side of said bearing element which permits sliding on the floor;

wherein each slide element is provided with a layer of polyoxymethylene on an outer surface of said respective slide element;

wherein each height adjuster has a threaded bolt extending from the respective bearing element, and each height adjuster has an adjusting nut; and wherein said two adjustable height weight bearing assemblies cooperate with said two fixed height weight bearing assemblies to permit adjustment of a uniform load onto all four bearings, to prevent deformities of the sounds box, and to improve tuning stability in spite of floor unevenness; wherein each beating element includes a recess containing a majority of a main block of the slide element; wherein each slide element has a substantially uniform geometry, lacking projections therefrom.

* * * * *